US009074324B2

(12) United States Patent
Shannon et al.

(10) Patent No.: US 9,074,324 B2
(45) **Date of Patent: *Jul. 7, 2015**

(54) LAYERED TISSUE STRUCTURES COMPRISING MACROALGAE

(71) Applicant: Kimberly-Clark Worldwide, Inc., Neenah, WI (US)

(72) Inventors: Thomas Gerard Shannon, Neenah, WI (US); Jeffrey James Timm, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/358,949

(22) PCT Filed: Jun. 10, 2013

(86) PCT No.: PCT/US2013/044891

§ 371 (c)(1),
(2) Date: May 16, 2014

(87) PCT Pub. No.: WO2014/200455

PCT Pub. Date: Dec. 18, 2014

(65) Prior Publication Data

US 2015/0144280 A1 May 28, 2015

(51) Int. Cl.

| | |
|---|---|
| ***D21H 11/12*** | (2006.01) |
| ***D21H 27/40*** | (2006.01) |
| ***D21H 27/38*** | (2006.01) |
| ***D21H 27/00*** | (2006.01) |
| ***D21H 11/04*** | (2006.01) |

(52) U.S. Cl.

CPC ..... *D21H 27/40* (2013.01); *D21H 27/38* (2013.01); *D21H 27/005* (2013.01); *D21H 11/04* (2013.01); *D21H 11/12* (2013.01)

(58) Field of Classification Search

None

See application file for complete search history.

(56) References Cited

U.S. PATENT DOCUMENTS

| | | | |
|---|---|---|---|
| 1,367,279 | A | 2/1921 | Ignacy |
| 1,509,035 | A | 9/1924 | Thornley et al. |
| 1,675,244 | A | 6/1928 | Frederick |
| 2,965,436 | A | 12/1960 | De Domenico et al. |
| 3,862,877 | A | 1/1975 | Camden |
| 4,300,981 | A | 11/1981 | Carstens |
| 5,114,534 | A | 5/1992 | Rachor et al. |
| 5,200,194 | A | 4/1993 | Edgren et al. |
| 5,472,569 | A | 12/1995 | Nicolucci et al. |
| 5,500,086 | A | 3/1996 | Sakai et al. |
| 5,522,967 | A | 6/1996 | Shet |
| 5,567,275 | A | 10/1996 | Nicolucci et al. |
| 5,743,999 | A | 4/1998 | Kamps et al. |
| 6,332,952 | B1 | 12/2001 | Hsu et al. |
| 6,379,594 | B1 | 4/2002 | Dopfner et al. |
| 7,622,019 | B2 | 11/2009 | You et al. |
| 7,972,474 | B2 | 7/2011 | Underhill et al. |
| 8,298,374 | B2 | 10/2012 | Shannon et al. |
| 8,574,400 | B1 | 11/2013 | Shannon et al. |
| 2002/0104632 | A1 | 8/2002 | Jimenez et al. |
| 2003/0186611 | A1 | 10/2003 | Zikeli et al. |
| 2006/0137842 | A1 | 6/2006 | Garnier et al. |
| 2007/0207692 | A1 | 9/2007 | Ono et al. |
| 2009/0197994 | A1 | 8/2009 | Han et al. |
| 2010/0137776 | A1 | 6/2010 | Virkus et al. |
| 2010/0152687 | A1 | 6/2010 | Carlozzi |
| 2010/0272940 | A1 | 10/2010 | Shi et al. |
| 2010/0319865 | A1 | 12/2010 | Petersen et al. |
| 2011/0036525 | A1 | 2/2011 | Kim et al. |
| 2013/0312924 | A1 | 11/2013 | Shi et al. |

FOREIGN PATENT DOCUMENTS

| | | | |
|---|---|---|---|
| CN | 101985779 | A | 3/2011 |
| CN | 102154738 | A | 8/2011 |
| DE | 10 2004 061 179 | A1 | 6/2006 |
| DE | 10 2008 053 858 | A1 | 5/2010 |
| EP | 0 565 920 | B1 | 10/1995 |
| EP | 1 682 721 | B1 | 5/2009 |
| GB | 508 671 | A | 7/1939 |
| JP | 04-202872 | A | 7/1992 |
| JP | 04-202892 | A | 7/1992 |
| JP | 04-202893 | A | 7/1992 |
| JP | 05-331792 | A | 12/1993 |
| JP | 2000-236757 | A | 9/2000 |
| JP | 2011-012036 | A | 1/2011 |
| KR | 2006-0000695 | A | 1/2006 |
| KR | 10-0811183 | B1 | 3/2008 |

(Continued)

OTHER PUBLICATIONS

Earthrise® "Natural Spirulina Powder," Material Safety Data Sheet, Earthrise Nutritionals, Calipatria, CA, May 17, 2006, pp. 1-6.

Kim, Byong Hyun and Yung Bum Seo, "Application of Sea Algae Fiber for the Improvement of Compressibility and Physical Properties of Letter Press Printing Paper," Journal of Korea Technical Association of the Pulp and Paper Industry, vol. 4, No. 1, 2008, pp. 15-22.

Seo, Yung Bum et al., "Optical Properties of Red Algae Fibers," Industrial and Engineering Chemistry Research, American Chemical Society, vol. 49, No. 20, Sep. 28, 2010, pp. 9830-9833.

(Continued)

*Primary Examiner* — Richard Crispino
*Assistant Examiner* — Eric Yaary
(74) *Attorney, Agent, or Firm* — Kimberly-Clark Worldwide, Inc.

(57) ABSTRACT

The disclosure provides tissue webs, and products incorporating the same, where the webs comprise macroalgae fibers. More specifically the disclosure provides soft and durable tissue webs comprising at least about 1 percent macroalgae fiber by weight of the web. In the tissue webs of the present disclosure, macroalgae fibers may preferably replace high average fiber length wood fibers, which increase the strength and durability of the web without negatively affecting stiffness.

19 Claims, No Drawings

(56) References Cited

FOREIGN PATENT DOCUMENTS

| | | | |
|---|---|---|---|
| KR | 10-0811193 | B1 | 3/2008 |
| KR | 10-0811194 | B1 | 3/2008 |
| KR | 10-0811196 | B1 | 3/2008 |
| KR | 10-0811200 | B1 | 3/2008 |
| KR | 10-0933462 | B1 | 12/2009 |
| KR | 10-2010-0011771 | A | 2/2010 |
| KR | 10-0965310 | B1 | 6/2010 |
| KR | 2010-0070240 | A | 6/2010 |
| KR | 2010-0084452 | A | 7/2010 |
| NL | 9001056 | A | 12/1991 |
| TW | 506831 | B | 10/2002 |
| WO | WO 92/02199 | A1 | 2/1992 |
| WO | WO 94/04745 | A1 | 3/1994 |
| WO | WO 96/24317 | A2 | 8/1996 |
| WO | WO 00/38625 | A2 | 7/2000 |
| WO | WO 2012/010181 | A1 | 1/2012 |

OTHER PUBLICATIONS

Seo, Yung-Bum et al., "Red Algae and Their Use in Papermaking," Bioresource Technology, vol. 101, 2010, pp. 2549-2553.

Ververis, C. et al., "Cellulose, Hemicelluloses, Lignin and Ash Content of Some Organic Materials and Their Suitability for Use as Paper Pulp Supplements," Bioresource Technology, vol. 98, 2007, pp. 296-301.

XX Internationa 1 Seaweed Symposium, International Seaweed Association, Ensenada Baja California Mexico, Feb. 22-26, 2010, pp. 1-2, 63, 108.

LAYERED TISSUE STRUCTURES COMPRISING MACROALGAE

RELATED APPLICATIONS

The present application is a national-phase entry, under 35 U.S.C. §371, of PCT Patent Application No. PCT/US2013/044891, filed on Jun. 10, 2013, which is incorporated herein by reference in a manner consistent with the instant application.

BACKGROUND

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on fiber length, aspect ratio and thickness of the fiber cell wall. Unfortunately, the need for softness is balanced by the need for durability. Durability in tissue products may be defined in terms of tensile strength, burst strength and tear strength. Typically tear strength and burst strength have a positive correlation with tensile strength while tensile strength, and thus durability, and softness are inversely related. Thus the paper maker is continuously challenged with the need to balance the need for softness with a need for durability. Unfortunately, tissue paper durability generally decreases as the average fiber length is reduced. Therefore, simply reducing the pulp average fiber length can result in an undesirable trade-off between product softness and product durability.

Besides durability, long fibers also play an important role in overall tissue product softness. While surface softness in tissue products is an important attribute, a second element in the overall softness of a tissue sheet is stiffness. Stiffness can be measured from the tensile slope of stress-strain tensile curve. Generally, a decrease in tensile slope results in lower stiffness, which typically provides better overall softness. However, at a given tensile strength and slope short fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by Northern softwood kraft ("NSWK") fibers typically supply the best combination of durability and softness in tissue products when those fibers are used in combination with hardwood kraft fibers, such as Eucalyptus hardwood kraft ("EHWK") fibers. While NSWK fibers have a higher coarseness than EHWK fibers, their small cell wall thickness relative to lumen diameter combined with their long length makes them the ideal candidate for optimizing durability and softness in tissue.

Unfortunately, supply of NSWK is under significant pressure both economically and environmentally. As such, prices of NSWK have escalated significantly creating a need to find alternatives to optimize softness and strength in tissue products. Another type of softwood fiber is Southern softwood kraft ("SSWK"), which is widely used in fluff pulp containing absorbent products such as diapers, feminine care absorbent products and incontinence products. Unfortunately while not under the same supply and environmental pressures as NSWK, SSWK fibers are generally poorly suited for making soft tissue products. While having long fiber length, the SSWK fibers have too wide a cell wall width and too narrow a lumen diameter and thus create stiffer, harsher feeling products than NSWK.

The tissue papermaker who is able to obtain pulps having a desirable combination of fiber length and coarseness from fiber blends generally regarded as inferior with respect to average fiber properties may reap significant cost savings and/or product improvements. For example, the papermaker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers. As such, a need currently exists for a tissue product formed from a fiber that will improve durability without negatively affecting other important product properties, such as softness.

Outside of softwood kraft pulp fibers very few options exist for papermakers when seeking a satisfactory fiber to provide strength without negatively impacting softness. Thus, there remains a need for alternative papermaking fibers that may deliver softness while maintaining satisfactory strength.

SUMMARY

It has now been discovered that macroalgae fibers, despite having a relatively short average fiber length and high aspect ratios, may be incorporated into a tissue web, and particularly the skin contacting layer of a multi-layered web, also referred to herein as the air contacting side or non-fabric contacting side, to yield webs having improved strength without a significant increase in stiffness. Surprisingly, these properties are particularly acute when macroalgae fibers are substituted for wood fibers in relatively modest amounts, such as less than about 5 percent, and more preferably less than about 3 percent, such as from about 0.5 to about 3 percent by weight of the web, and when the fabric contacting layer of the web is substantially free from macroalgae fibers.

Accordingly, in certain embodiments, the present disclosure provides a multi-layered tissue web comprising a fabric contacting fibrous layer and a non-fabric contacting fibrous layer, wherein the fabric contacting fibrous layer consists essentially of conventional papermaking fibers and the non-fabric contacting fibrous layer comprises a blend of macroalgae fibers and conventional papermaking fibers. Preferably the fabric contacting layer is substantially free of macroalgae fibers and the tissue web comprises from about 0.5 to about 5 percent by weight macroalgae fibers. In a particularly preferred embodiment the fabric contacting fibrous layer comprises hardwood kraft fibers and the non-fabric contacting fibrous layer comprises macroalgae and softwood kraft fibers.

In yet other embodiments the present disclosure provides a multi-layered tissue web comprising a fabric contacting fibrous layer and a non-fabric contacting fibrous layer, wherein the fabric contacting fibrous layer is substantially free of macroalgae fibers and the non-fabric contacting fibrous layer comprises from about 0.5 to about 5 percent by weight of the web macroalgae fibers, the tissue web having a basis weight greater than about 35 gsm, a geometric mean tensile of at least about 800 g/3" and geometric mean slope of less than about 6 kg.

In still other embodiments the present disclosure provides a method of forming a macroalgae tissue web comprising the steps of dispersing a dry lap pulp comprising from about 1 to about 30 percent by weight macroalgae to form a first fiber slurry, dispersing a conventional papermaking pulp to form a second fiber slurry, depositing the second fiber slurry onto a forming fabric, depositing the first fiber slurry adjacent to the second fiber slurry to form a wet web, dewatering the wet web to a consistency from about 20 to about 30 percent, and drying the wet web to a consistency of greater than about 90 percent thereby forming a macroalgae tissue web.

DEFINITIONS

As used herein the term "macroalgae fibers" refers to any cellulosic fibrous material derived from red algae such as, for example, *Gelidium elegance, Gelidium corneum, Gelidium amansii, Gelidium robustum, Gelidium chilense, Gracelaria verrucosa, Eucheuma Cottonii, Eucheuma Spinosum*, or *Beludul*, or brown algae such as, for example, *Pterocladia capillacea, Pterocladia lucia, Laminaria japonica, Lessonia nigrescens*. Macroalgae fibers generally have an aspect ratio (measured as the average fiber length divided by the average fiber width) of at least about 80.

As used herein the term "red algae fiber" refers to any cellulosic fibrous material derived from Rhodophyta. Particularly preferred red algae fiber includes cellulosic fibrous material derived from *Gelidium amansii, Gelidium corneum, Gelidium asperum, Gelidium chilense* and *Gelidium robustum*. Red algae fibers generally have an aspect ratio (measured as the average fiber length divided by the average fiber width) of at least about 80.

As used herein the term "geometric mean tensile" (GMT) refers to the square root of the product of the MD tensile strength and CD tensile strength of the web, which are measured as described in the Test Methods section.

As used herein, the term "slope" refers to slope of the line resulting from plotting tensile versus stretch and is an output of the MTS TestWorks™ in the course of determining the tensile strength as described in the Test Methods section. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope.

As used herein the term "Machine Direction Durability" generally refers to the ability of the web to resist crack propagation initiated by defects in the web and is calculated from MD Tensile Index (calculated by dividing the MD Tensile Strength by the basis weight) and MD stretch (output of the MTS TestWorks™ in the course of determining the tensile strength as described in the Test Methods section) according to the formula:

$$\text{Machine Direction Durability}=0.6(\text{MD Tensile Index}^{0.74}+\text{MD Stretch}^{0.58})$$

As used herein, the term "Stiffness Index" refers to the quotient of the geometric mean slope (having units of kgf) divided by the geometric mean tensile strength (having units of g/3") multiplied by 1,000.

As used herein the term "average fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where
k=maximum fiber length
$x_i$=fiber length
$n_i$=number of fibers having length $x_i$
n=total number of fibers measured.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "basis weight" generally refers to the bone dry weight per unit area of a tissue and is generally expressed as grams per square meter (gsm). Basis weight is measured using TAPPI test method T-220.

As used herein, the term "sheet bulk" generally refers to the quotient of the sheet caliper expressed in microns, divided by the dry basis weight, expressed in grams per square meter. The resulting sheet bulk is expressed in cubic centimeters per gram.

As used herein, the term "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments, between about 10 to about 60 gsm.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION

In general, the present disclosure relates to tissue webs, and products produced therefrom, comprising conventional papermaking fibers and macroalgae fibers. It has been discovered that by replacing some of the conventional papermaking fibers in the tissue web with macroalgae fibers, and more specifically conventional fibers disposed in the non-fabric contacting layer of a multi-layer tissue structure, that a stronger and more durable web may be produced without sacrificing softness.

The discovery that macroalgae fibers may be used to form soft, strong tissue webs and more specifically that macroalgae fibers displacing conventional fibers in the non-fabric contacting layer, is particularly surprising provided the relative short length of macroalgae fibers and their high aspect ratio. Table 1 compares the fiber properties of three different fibers—hardwood, softwood and macroalgae.

TABLE 1

| Fiber Type | Average Fiber Length (mm) | Average Fiber Width (μm) | Fiber Length: Fiber Width |
|---|---|---|---|
| *G. amansii* | 0.7 | 5 | 140 |
| NSWK Pulp Fiber | 2.18 | 27.6 | 79 |
| EHWK Pulp Fiber | 0.76 | 19.1 | 40 |

For macroalgae pulp fibers, the ratio of length to width (commonly referred to as the "aspect ratio") generally varies between about 120 and about 250, although both length and width vary amongst species. Generally, average fiber lengths for macroalgae fibers range from about 0.3 to about 1.0 mm, while fiber width varies from about 3 to about 7 μm. As shown in Table 1, macroalgae fibers are generally shorter than both EHWK and NSWK fibers, but have significantly greater aspect ratios.

Despite the tendency of macroalgae fibers to have high aspect ratios and short average fiber lengths it has now been surprisingly discovered that they may be a satisfactory replacement for conventional papermaking fibers in tissue webs. In particular, it has been surprisingly discovered that selectively incorporating macroalgae fibers into the non-fabric contacting layer of a multi-layered tissue structure actually increases tensile strength without negatively effecting stiffness. In fact, in certain instances, the increase in tensile may be accompanied by only a slight increase in geometric mean modulus, resulting in a web having a lower stiffness index. Previously, it was believed that the greatest benefit was achieved when macroalgae fibers were used to replace a portion of the long fiber fraction in the middle, or non-skin contacting surface. However, it has now been discovered that the beneficial effect on tensile and stiffness is particularly acute when the macroalgae is substituted for convention papermaking fibers in the non-fabric contacting layer of a multi-layered web as illustrated in the tables below.

TABLE 2

| | Macro-algae (wt %) | Basis Wt. (gsm) | GMT (g/3") | MD Tensile Index | GM Slope (kgf) | Stiff-ness Index | MD Durability Index |
|---|---|---|---|---|---|---|---|
| Control | 0 | 33.9 | 605 | 23.6 | 5.52 | 9.12 | 9.03 |
| Air Layer | 4.5 | 34.1 | 873 | 35.9 | 6.93 | 7.94 | 11.40 |
| Fabric Layer | 4.5 | 34.5 | 711 | 31.3 | 6.97 | 9.80 | 10.57 |

TABLE 3

| | Delta GMT | Delta Stiffness Index | Delta MD Durability Index |
|---|---|---|---|
| Air Layer | 44% | −13% | 26% |
| Fabric Layer | 18% | 7% | 17% |

The macroalgae fibers are preferably derived from algae from the Division Rhodophyta. More preferably the macroalgae fibers have been subjected to processing to remove hydrocolloids, and more preferably agar, from the cell wall. For example, macroalgae fibers may be processed by extracting heteropolysaccharides as a cell wall component with hot water, followed by freezing, melting and drying. More preferably the macroalgae fibers are prepared using pulping methods known in the art such as those disclosed in U.S. Pat. No. 7,622,019, the contents of which are incorporated herein in a manner consistent with the present disclosure. Regardless of the specific method of extraction, in certain embodiments it may be desirable that the macroalgae fibers have been processed such that the resulting fibers have an agar content of less than about 5 percent by weight of the fibers, more preferably less than about 3 percent by weight of the fibers and still more preferably less than about 2 percent by weight of the fibers.

In certain embodiments the pulped macroalgae fibers may be subjected to bleaching. For example, pulped macroalgae fibers may be subjected to a two stage bleaching treatment using a chlorine dioxide in the first stage and hydrogen peroxide in the second stage. In the first stage 5 percent active chlorine dioxide by dry weight of the material may be used to bleach the fiber at pH 3.5 and 80° C. for about 60 minutes. In the second stage, 5 percent active hydrogen peroxide by dry weight of the material may be used to bleach the fiber at pH 12 and 80° C. for about 60 minutes.

The macroalgae fibers preferably have an average fiber length greater than about 300 μm, such as from about 300 to about 1000 μm and more preferably from about 300 to about 700 μm. The macroalgae fibers preferably have a width greater than about 3 μm, such as from about 3 to about 10 μm, and more preferably from about 5 to about 7 μm. Accordingly, it is preferred that the macroalgae fibers have an aspect ratio greater than about 80, such as from about 100 to about 400 and more preferably from about 150 to about 350.

The macroalgae pulp fibers may be used as either dry or wet lap pulps. In those embodiments where the macroalgae is used as a dry lap (a pulp having a moisture content less than about 50 percent, more preferably from about 1 to about 15 percent) it is preferred that it is coprocessed with conventional papermaking fibers and more preferably that the pulped macroalgae fibers are not dried prior to processing with conventional papermaking fibers.

In particularly preferred embodiments macroalgae fibers are provided as dry lap pulps, a fibrous web having a basis weight of at least about 150 grams per square meter (gsm) and a moisture content of less than about 30 percent and more preferably less than about 20 percent, such as from about 1 to about 10 percent moisture. The macroalgae pulps are preferably provided as a blend of macroalgae pulp fiber and conventional papermaking fibers, such that the pulp comprises less than about 30 percent macroalgae fibers by weight. The dry lap pulps may be manufactured by blending never-dried macroalgae fibers with conventional papermaking fibers, forming a wet fiber web from the blended fibers and then drying the fiber web to form dry pulp sheets. The resulting pulp sheets surprisingly have improved strength and durability compared to both pulp sheets formed from dried macroalgae fibers and pulp sheets formed from conventional papermaking fibers alone. Further, pulps prepared as described herein are readily dispersible using traditional processing equipment, such as hydropulpers.

Regardless of the species or particular average fiber length, tissue webs of the present disclosure comprise at least about 0.5 percent macroalgae by total weight of the web and more preferably at least about 1 percent and still more preferably from about 2 to about 5 percent. The tissue webs comprising macroalgae may be either blended or layered webs. Where the webs are multi-layered, they may be layered such that one layer is substantially free from macroalgae fibers, while another layer comprises conventional papermaking and macroalgae fibers. It should be understood that, when referring to a layer that is substantially free of macroalgae fibers, negligible amounts of the fibers may be present therein, however, such small amounts often arise from the macroalgae fibers applied to an adjacent layer, and do not typically substantially affect the softness or other physical characteristics of the web.

Conventional papermaking fibers may comprise wood pulp fibers formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, eucalyptus, maple, birch, aspen, and the like. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In a particularly preferred embodiment macroalgae fibers are utilized in the tissue web as a replacement for low average fiber length wood fibers such as hardwood fibers and more specifically Eucalyptus kraft fibers. In one particular embodiment, macroalgae fibers are incorporated into a multi-layered web having a middle layer disposed between an air contacting layer (non-fabric contacting layer) and a fabric contacting layer where the air contacting layer comprises a blend of hardwood fibers and macroalgae fibers, the middle layer comprises softwood fibers and the fabric contacting layer comprises hardwood fibers and is substantially free from macroalgae fibers. In such embodiments the macroalgae fiber may be added to the air contacting layer such that the total web comprises about 0.5 percent by total weight of the web macroalgae fibers, such as from about 1 to about 5 percent and more preferably from about 2 to about 3 percent.

In addition to varying the amount of macroalgae within the web, as well as the amount in any given layer, the physical properties of the web may be varied by specifically selecting a particular layer or layers for incorporation of the macroalgae fibers. It has now been discovered that the greatest increase in tensile is achieved by selectively incorporating the macroalgae fibers in a multi-layered web such that the layer comprising macroalgae is not brought into contact with the forming fabric during formation of the web.

In a particularly preferred embodiment, the present disclosure provides a tissue web having enhanced tensile strength without a corresponding increase in stiffness, where the multi-layered tissue web comprises fabric and non-fabric contacting layers, wherein the fabric contacting fibrous layer comprises conventional papermaking fibers and is substantially free from macroalgae fibers and the non-fabric contacting fibrous layer comprises conventional papermaking fibers and macroalgae fibers. Preferably the webs have a tensile strength greater than about 500 g/3", such as from about 500 to about 1000 g/3", and more preferably from about 700 to about 800 g/3", yet have a Stiffness Index less than about 10, and more preferably less than about 9, such as from about 7 to about 9.

In still other embodiments, the present disclosure provides tissue webs having enhanced bulk, softness and durability. Improved durability, such as increased machine and cross-machine direction stretch (MD Stretch and CD Stretch), and improved softness may be measured as a reduction in the slope of the tensile-strain curve (measured as GM Slope) or the Stiffness Index. For example, tissue webs prepared as described herein generally have a GM Slope less than about 9.0 kgf, such as from about 6.0 to about 9.0 kgf and more preferably from about 6.5 to about 7.5 kgf. The GM Slopes are achieved at relatively modest tensile strengths, such as a GMT from about 700 to about 900 g/3", yielding Stiffness Indexes from about 7 to about 9.

Similarly, webs may also have MD Stretch from greater than about 12 percent and more preferably greater than about 15 percent, such as from about 15 to about 20 percent, yielding webs having Machine Direction Durability greater than about 10, such as from about 10 to about 12 and more preferably from about 10.5 to about 11.5.

Webs prepared as described herein may be converted into either single or multi-ply rolled tissue products that have improved properties over the prior art. In one embodiment the present disclosure provides a rolled tissue product comprising a spirally wound tissue web having at least two layers wherein the air contacting layer comprising less than about 5 percent macroalgae by weight of the web and wherein the tissue web has a bone dry basis weight greater than about 35 gsm, a sheet bulk greater than about 15 cc/g and a Stiffness Index less than about 9.

The tissue webs may also be incorporated into tissue products that may be either single- or multi-ply, where one or more of the plies may be formed by a multi-layered tissue web having macroalgae fibers selectively incorporated in one of its layers. In one embodiment the tissue product is constructed such that the macroalgae fibers are brought into contact with the user's skin in-use. For example, the tissue product may comprise two multi-layered through-air dried webs wherein each web comprises a fabric contacting fibrous layer substantially free from macroalgae and a non-fabric contacting fibrous layer comprising macroalgae. The webs are plied together such that the outer surface of the tissue product is formed from the fabric contacting fibrous layers of each web, such that the surface brought into contact with the user's skin in-use comprises macroalgae fibers.

If desired, various chemical compositions may be applied to one or more layers of the multi-layered tissue web to further enhance softness and/or reduce the generation of lint or slough. For example, in some embodiments, a wet strength agent can be utilized to further increase the strength of the tissue product when wet. As used herein, a "wet strength agent" is any material that when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts depending on the desired characteristics of the web. For instance, in some embodiments, the total amount of wet strength agents added can be between about 1 to about 60 pounds per ton (lbs/T), in some embodiments between about 5 to about 30 lbs/T, and in some embodiments between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

Tissue webs of the present disclosure can generally be formed by any of a variety of papermaking processes known in the art. Preferably the tissue web is formed by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From the forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric or, preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade.

Once creped from the second dryer drum, the web may, optionally, be fed around a cooling reel drum and cooled prior to being wound on a reel.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

In other embodiments, the base web is formed by an uncreped through-air drying process such as those described, for example, in U.S. Pat. Nos. 5,656,132 and 6,017,417, both of which are hereby incorporated by reference herein in a manner consistent with the present disclosure. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). The wet web is then transferred from the forming fabric to a transfer fabric while at a solids consistency of between about 10 to about 35 percent and, particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer." During "rush transfer," many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure. The wet tissue web is then transferred from the transfer fabric to a throughdrying fabric.

While supported by the throughdrying fabric, the wet tissue web is dried to a final consistency of about 94 percent or greater by a throughdryer. The drying process can be any noncompressive drying method which tends to preserve the bulk or thickness of the wet web including, without limitation, throughdrying, infra-red radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. No. 6,998,024. Other suitable throughdrying fabrics include those disclosed in U.S. Pat. No. 7,611,607, which is incorporated herein in a manner consistent with the present disclosure, particularly the fabrics denoted as Fred (t1207-77), Jetson (t1207-6) and Jack (t1207-12). The web is preferably dried to final dryness on the throughdrying fabric, without being pressed against the surface of a Yankee dryer, and without subsequent creping.

Additionally, webs prepared according to the present disclosure may be subjected to any suitable post processing including, but not limited to, printing, embossing, calendering, slitting, folding, combining with other fibrous structures, and the like.

TEST METHODS

Tensile

Samples for tensile strength testing are prepared by cutting a 3" (76.2 mm)×5" (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 2±0.04 inches (50.8±1 mm). The jaws are operated using pneumatic-action and are rubber coated. The minimum grip face width is 3" (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

EXAMPLES

Commodity pulps were obtained as follows—Eucalyptus kraft pulp ("EHWK") was obtained from Fibria, San Paulo, Brazil, Southern softwood kraft pulp ("SSWK") was obtained from Abitibi Bowater, Mobile, Ala., North softwood kraft pulp ("NSWK") was obtained from Northern Pulp Nova Scotia Corporation, Abercrombie, NS, and wet (never-dried) red algae pulp was obtained from Pegasus International, Daejeon, Korea.

Dry lap red algae pulp ("RA") was prepared by blending EHWK with wet red algae pulp and forming a dry lap pulp sheet using a Fourdrinier machine comprising a wire forming section, a suction box, a pair of registered wet press rolls, and three cylindrical air dryers. Each fiber type was weighed individually and dispersed in a pulper for 25 to 30 minutes, yielding a fiber slurry with a consistency of 3 percent, and then returned to a stock tank for use in the formation of the pulp sheet. The entire stock preparation system was heated to 50° C.

The fiber slurries were mixed depending on the desired blend of the dry lap pulp and then pumped to the headbox and deposited onto the forming section of the paper machine under pressure to increase drainage. The resulting fibrous web was pressed to further remove water using weight of the first press roll, which was adjusted to maximize caliper. The dewatered fibrous web was subjected to drying using a series of dryer cans, the initial dryer can pressure was 100 pounds per square inch (psig) in the first, second, and third section, corresponding to about 177° C. The resulting dry lap pulp sheet had a moisture content of less than about 10 percent and a basis weight of about 230 gsm.

A single ply through-air dried tissue web was made generally in accordance with U.S. Pat. No. 5,607,551, which is herein incorporated by reference in a manner consistent with the present disclosure. Initially NSWK was dispersed in a pulper for 30 minutes at 3 percent consistency at about 100° F. The NSWK was then transferred to a dump chest and subsequently diluted to approximately 0.75 percent consistency. EHWK was dispersed in a pulper for 30 minutes at about 3 percent consistency at about 100° F. The EHWK was then transferred to a dump chest and subsequently diluted to about 0.75 percent consistency. Two separate dispersions of red algae (RA) dry lap pulp were prepared depending upon which layer of the tissue web the red algae was to be added to. Dry lap red algae pulps (80 wt % EHWK and 20 wt % red algae) prepared as described above were dispersed in a pulper for 30 minutes at about 3 percent consistency at about 100° F. and then transferred to a dump chest and subsequently diluted to about 0.75 percent consistency.

The pulp slurries were subsequently pumped to separate machine chests and further diluted to a consistency of about 0.1 percent. Pulp fibers from each machine chest were sent through separate manifolds in the headbox to create a 3-layered tissue structure. The flow rates of the stock pulp fiber slurries into the flow spreader were adjusted to give a target web basis. The fiber compositions of the layered sheets are described in Table 4 below. The formed web was non-compressively dewatered and rush transferred to a transfer fabric traveling at a speed about 28 percent slower than the forming fabric. The web was then transferred to a throughdrying fabric and dried.

The base sheet webs were converted into various bath tissue rolls. Specifically, base sheet was calendered using one or two conventional polyurethane/steel calenders comprising either a 4 or a 40 P&J polyurethane roll on the air contacting side of the sheet and a standard steel roll on the fabric contacting side. Table 4 shows the process conditions for each of the samples prepared in accordance with the present example. Tables 5 and 6 summarize the physical properties of the finished product.

TABLE 4

| Sample | NBSK Center Layer (wt %) | Air Contacting Layer (wt %) | Fabric Contacting Layer (wt %) | Starch (kg/MT) | Debonder (kg/MT) |
|---|---|---|---|---|---|
| Control 1 | 40 | 30 EHWK | 30 EHWK | 0 | 0 |
| Control 2 | 40 | 30 EHWK | 30 EHWK | 3 | 0 |
| Control 3 | 40 | 30 EHWK | 30 EHWK | 6 | 0 |
| 18 | 40 | 2.25 RA<br>27.75 EHWK | 2.25 RA<br>27.75 EHWK | 0 | 0 |
| 19 | 40 | 2.25 RA<br>27.75 EHWK | 2.25 RA<br>27.75 EHWK | 3 | 0 |
| 20 | 40 | 4.5 RA<br>25.5 EHWK | 4.5 RA<br>25.5 EHWK | 0 | 0 |
| 21 | 40 | 4.5 RA<br>25.5 EHWK | 4.5 RA<br>25.5 EHWK | 0 | 4 |
| 24 | 40 | 30 EHWK | 9 RA<br>21 EHWK | 0 | 0 |
| 25 | 40 | 30 EHWK | 9 RA<br>21 EHWK | 2 | 0 |
| 26 | 40 | 9 RA<br>21 EHWK | 30 EHWK | 2 | 0 |
| 27 | 40 | 9 RA<br>21 EHWK | 30 EHWK | 2 | 5 |
| 37 | 40 | 4.5 RA<br>25.5 EHWK | 30 EHWK | 0 | 0 |
| 38 | 40 | 30 EHWK | 4.5 RA<br>25.5 EHWK | 0 | 0 |

TABLE 5

| Sample | GMT (g/3") | Basis Wt. (gsm) | Sheet Caliper (μm) | Sheet Bulk (cc/g) | GM Slope (kgf) | Stiffness Index |
|---|---|---|---|---|---|---|
| Control 1 | 605 | 33.9 | 379 | 11.2 | 5.52 | 9.12 |
| Control 2 | 855 | 34.3 | 392 | 11.4 | 6.79 | 7.94 |
| Control 3 | 974 | 33.7 | 413 | 12.3 | 7.94 | 8.15 |
| 18 | 855 | 33.2 | 363 | 10.9 | 7.44 | 8.70 |
| 19 | 1090 | 33.3 | 388 | 11.7 | 9.28 | 8.51 |
| 20 | 1055 | 33.3 | 391 | 11.7 | 10.64 | 10.09 |
| 21 | 887 | 33.2 | 382 | 11.5 | 8.42 | 9.49 |
| 24 | 637 | 33.9 | 403 | 11.9 | 6.69 | 10.50 |
| 25 | 817 | 33.1 | 430 | 13.0 | 6.66 | 8.15 |
| 26 | 1148 | 33.6 | 404 | 12.0 | 8.71 | 7.59 |
| 27 | 687 | 33.5 | 392 | 11.7 | 6.1 | 8.88 |
| 37 | 873 | 34.1 | 394 | 11.5 | 6.93 | 7.94 |
| 38 | 711 | 34.5 | 405 | 11.7 | 6.97 | 9.80 |

TABLE 6

| Sample | MD Tensile (g/3") | MD Tensile Index | MD Stretch (%) | MD Durability Index |
|---|---|---|---|---|
| Control 1 | 799.0 | 23.6 | 14.35 | 9.03 |
| Control 2 | 1126.4 | 32.8 | 15.60 | 10.90 |
| Control 3 | 1292.6 | 38.4 | 16.83 | 12.00 |

TABLE 6-continued

| Sample | MD Tensile (g/3") | MD Tensile Index | MD Stretch (%) | MD Durability Index |
|---|---|---|---|---|
| 18 | 1202.7 | 36.2 | 16.25 | 11.57 |
| 19 | 1515.5 | 45.5 | 17.06 | 13.23 |
| 20 | 1526.7 | 45.8 | 16.73 | 13.25 |
| 21 | 1350.5 | 40.7 | 17.07 | 12.42 |
| 24 | 840.9 | 24.8 | 13.94 | 9.22 |
| 25 | 1120.8 | 33.9 | 15.66 | 11.09 |
| 26 | 1615.6 | 48.1 | 16.02 | 13.54 |
| 27 | 990.8 | 29.6 | 14.28 | 10.16 |
| 37 | 1223.9 | 35.9 | 15.26 | 11.40 |
| 38 | 1079.3 | 31.3 | 15.18 | 10.57 |

The relative change in the GMT, MD Tensile Index, MD Durability Index and Stiffness Index, compared to an identical control without macroalgae, is summarized in Table 7 below.

TABLE 7

| Sample | RA (wt %) | RA Layer | Delta GMT | Delta Stiffness Index | Delta MD Durability Index |
|---|---|---|---|---|---|
| Control 1 | 0 | — | — | — | — |
| 18 | 4.5% | Air/Fabric | 41% | −5% | 28% |
| 37 | 4.5% | Air | 44% | −13% | 26% |
| 38 | 4.5% | Fabric | 18% | 7% | 17% |

While tissue webs and products comprising the same have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

We claim:

1. A layered tissue web comprising a first air contacting layer and a second fabric contacting layer, wherein the first air contacting layer comprises from 0.5 to 4.5 weight percent macroalgae fibers by weight of the web, and wherein the second fabric contacting layer is substantially free of macroalgae fibers.

2. The layered tissue web of claim 1 having a Stiffness Index of less than about 10.

3. The layered tissue web of claim 1 having an MD Durability Index of greater than about 10.

4. The layered tissue web of claim 1 having a basis weight from about 15 gsm to about 60 gsm, a geometric mean tensile index of at least about 30 and geometric mean slope of less than about 10 kgf.

5. The layered tissue web of claim 1 having a geometric mean tensile from about 700 to about 1000 g/3" and a geometric mean slope from about 6.0 to about 9.0 kgf.

6. The layered tissue web of claim 1 having a basis weight from about 15 to about 45 gsm.

7. The layered tissue web of claim 1 wherein the first air contacting layer comprise from about 2 to about 4 weight percent macroalgae fibers by weight of the web.

8. The layered tissue web of claim 1 wherein the macroalgae fibers are red algae pulp fibers derived from *Gelidium elegance, Gelidium corneum, Gelidium amansii, Gelidium robustum, Gelidium chilense, Gracelaria verrucosa, Eucheuma Cottonii, Eucheuma Spinosum*, or *Beludul.*

9. A layered tissue web comprising an air contacting layer comprising conventional papermaking fibers and from 0.5 to 4.5 weight percent macroalgae fibers by weight of the web, a middle layer comprising conventional papermaking fibers and a fabric contacting layer comprising conventional papermaking fibers, wherein the fabric contacting layer and the middle layer are substantially free of macroalgae fibers.

10. The layered tissue web of claim 9 wherein the middle layer is substantially free of macroalgae fibers.

11. The layered tissue web of claim 9 wherein the fabric contacting layer comprises hardwood fibers, the middle layer comprises softwood fibers and the air contacting layer comprises macroalgae and hardwood fibers.

12. The layered tissue web of claim 9 wherein the middle layer comprises hardwood fibers.

13. The layered tissue web of claim 9 having a basis weight greater than about 15 gsm, a geometric mean tensile index of at least about 30 and a geometric mean slope of less than about 10 kg.

14. The layered tissue web of claim 9 having a Stiffness Index of less than about 10.

15. The layered tissue web of claim 9 having an MD Durability Index of greater than about 10.

16. A method of forming a layered tissue web comprising the steps of:

a. dispersing a macroalgae dry lap pulp to form a first fiber slurry;

b. dispersing a conventional papermaking pulp to form a second fiber slurry substantially free of macroalgae fibers;

c. depositing the first and second fiber slurries onto a forming fabric such that the second fiber slurry contacts the forming fabric and the first fiber slurry contacts the air to form a wet web;

d. dewatering the wet web to a consistency of from about 20 to about 30 percent; and e. drying the wet web to a consistency of greater than about 90 percent thereby forming a dried macroalgae tissue web, wherein the dried macroalgae tissue web comprises from 0.5 to 4.5 weight percent macroalgae fibers.

17. The method of claim 16 wherein the macroalgae dry lap pulp has a moisture content of less than about 10 percent and wherein the macroalgae dry lap pulp comprises from about 1 to about 30 percent by weight of the dry lap pulp macroalgae pulp fibers and from about 70 to about 99 percent by weight of the dry lap pulp conventional papermaking fibers.

18. The method of claim 16 further comprising the steps of transferring the dewatered web from the forming fabric to a transfer fabric traveling at a speed from about 10 to about 40 percent slower than the forming fabric; and transferring the web to a throughdrying fabric.

19. The method of claim 16 wherein the drying step comprises transferring the dewatered web to the surface of a Yankee dryer and further comprising the step of creping the dried macroalgae tissue web from the surface of the Yankee dryer.

* * * * *